US006131540A

United States Patent [19]

Bronkal

[11] Patent Number: 6,131,540

[45] Date of Patent: Oct. 17, 2000

[54] FUEL INJECTION VALVE FOR HIGH PRESSURE INJECTION

[75] Inventor: Bernhard Bronkal, Koengen, Germany

[73] Assignee: Robert Bosch GmbH, Stuttgart, Germany

[21] Appl. No.: 09/000,138

[22] PCT Filed: Dec. 11, 1996

[86] PCT No.: PCT/DE96/02378

§ 371 Date: Jan. 14, 1998

§ 102(e) Date: Jan. 14, 1998

[87] PCT Pub. No.: WO97/43542

PCT Pub. Date: Nov. 20, 1997

[30] Foreign Application Priority Data

May 15, 1996 [DE] Germany ..... 196 19 523

[51] Int. Cl.[7] ..... F01D 1/06

[52] U.S. Cl. ..... 123/41.31; 123/467

[58] Field of Search ..... 123/467, 41.31, 123/458, 472; 239/585.1

[56] References Cited

U.S. PATENT DOCUMENTS

| | | | |
|---|---|---|---|
| 4,345,565 | 8/1982 | Bottoms | 123/467 |
| 4,984,549 | 1/1991 | Mesenich | 123/472 |
| 5,076,241 | 12/1991 | Takahashi | 123/41.31 |
| 5,156,132 | 10/1992 | Iwanaga | 123/467 |
| 5,329,908 | 7/1994 | Tarr | 123/472 |
| 5,694,903 | 12/1997 | Ganser | 123/467 |

*Primary Examiner*—Carl S. Miller

*Attorney, Agent, or Firm*—Ronald E. Greigg; Edwin E. Greigg

[57] ABSTRACT

A fuel injection valve which is provided for high pressure injection in self-igniting internal combustion engines and has a solenoid valve for controlling the injection. To trigger this solenoid valve, a control circuit is provided which is subdivided into a first circuit part and a second circuit part. The second circuit part is separate from the first circuit part, which jointly serves to control a number of injection valves, and are disposed on each individual injection valve. The housing is clipped onto the fuel injection valve and fuel flows through its interior for cooling purposes.

6 Claims, 1 Drawing Sheet

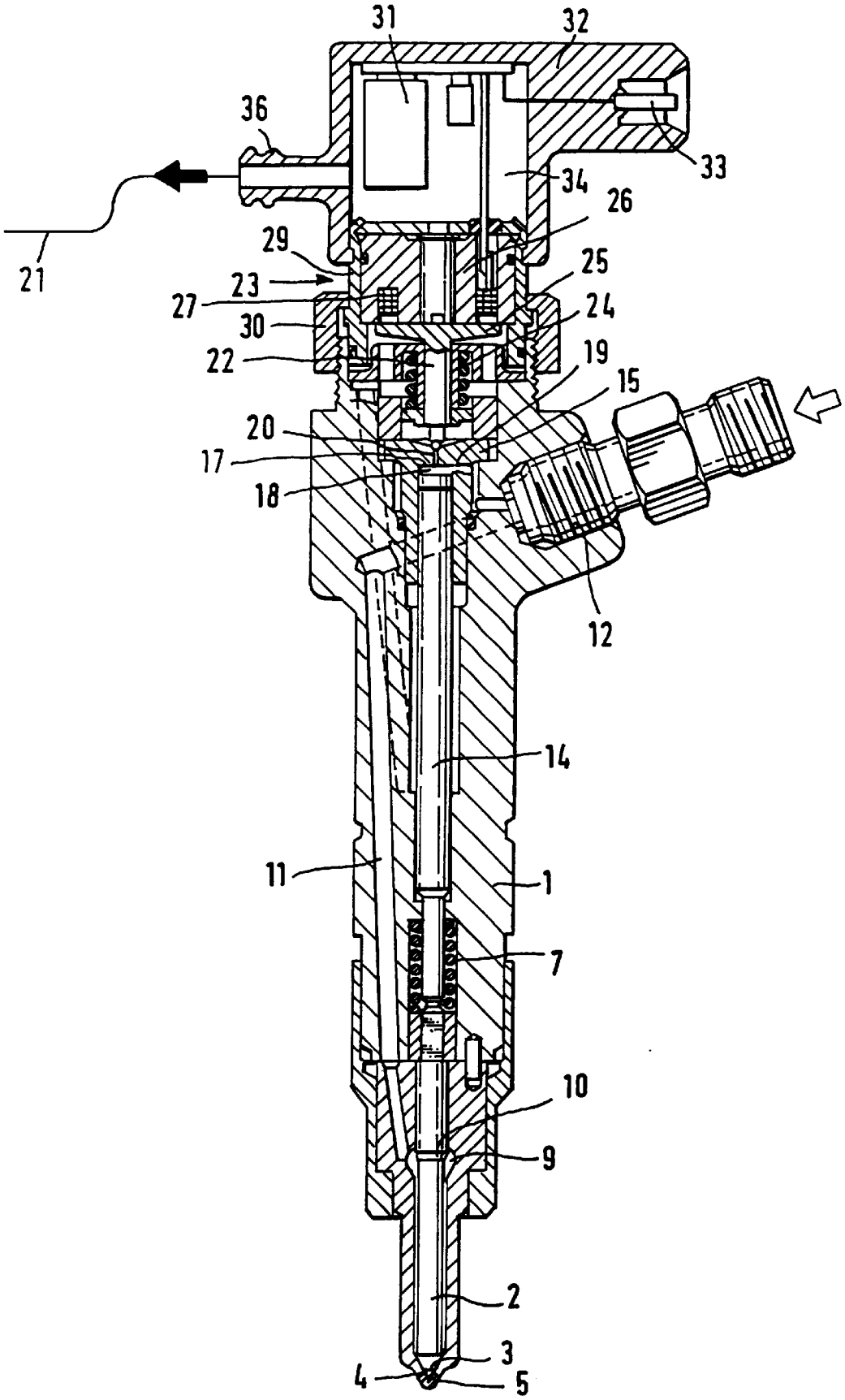
31
32
36
33
34
26
21
29
25
23
27
24
30
22
19
15
20
17
18
12
14
11
1
7
10
9
2
3
4
5

FUEL INJECTION VALVE FOR HIGH PRESSURE INJECTION

PRIOR ART

The invention is based on a fuel injection valve for high pressure injections. U.S. Pat. No. 4,972,997 has disclosed a fuel injection valve of this kind, which is supplied with fuel from a high pressure reservoir. The control of the injection is carried out in an electrohydraulic manner by virtue of the fact that the high pressure fuel source supplies pressurized fuel to a control chamber. This control pressure is used to keep the valve member of the fuel injection valve in the closed position since the control surface acted on by the control pressure is greater than the surface impinged upon on the fuel injection valve. The control chamber continuously communicates with the high pressure fuel source via a first throttle and can be relieved via a second throttle that is controlled by a solenoid valve. As soon as the solenoid valve opens the second throttle, the control chamber is discharged and the pressure on the pressure surfaces of the valve member of the injection valve is sufficient to bring the valve member into the open position so that the injection can take place. If the second throttle is closed again by the solenoid valve, due to the pressure increase in the control chamber, the valve member is brought back into the closed position. The solenoid valve is attached to the housing of the fuel injection valve, coaxial to the axis of the valve member of the injection valve, and has a plug connection for the power supply of the electromagnet of the solenoid valve and furthermore, a discharge line is provided that leads from the electromagnet, via which the fuel diversion quantity at the second throttle can flow to a discharge chamber.

Fuel injection valves of this kind are switched by means of an electrical control device so that high pressure fuel is supplied to the internal combustion engine at the necessary time and in the quantity required. The electrical control circuit is disposed centrally in the vicinity of the fuel injection valves of which one is respectively provided for each cylinder of the associated engine. This disposition, though, has the disadvantage that long line connections that are acted on by high voltages and generate noise fields must be routed to the individual fuel injection valves. Furthermore, due to the available capacity for rapidly opening and closing of the solenoid valves, the heat that remains in the electrical control circuit has to be dissipated in a sufficient manner. This is connected with an additional expense.

ADVANTAGES OF THE INVENTION

The fuel injection valve according to the invention has the advantage over the prior art that the electrical control circuit is subdivided into a first circuit part and second circuit parts which are each provided directly on the fuel injection valve and which include control of the power supply to the electromagnet. It is particularly advantageous to provide the elements of the circuit in the second circuit part, which contain the power components and capacitors of the electrical control circuit. The heat produced particularly in the power components, capacitors, end stages, and diodes is distributed to the individual injection valves and can be dissipated there in an optimal fashion without further expenditure for a control of cooling devices. In particular, this prevents long lines that are highly affected by current from having to be provided. The power losses due to voltage drop are reduced and also, high-stress plug connections are avoided since the high currents only occur in the second circuit part and are guided immediately to the magnet in the shortest line connection. The short lines, moreover, have the additional advantage that noise radiation is reduced, which in particular can have an effect on the electrical circuit of the control device. The first part of the control circuit is reduced to the signal processing part of the circuit, which no longer experiences interference from feedback by means of the power part, which is respectively required for triggering the solenoid valve.

BRIEF DESCRIPTION OF THE DRAWING

The drawing represents a longitudinal sectional view through a fuel injection valve for high pressure injection with an integrated solenoid valve, which has an additionally integrated second circuit part according to the invention.

DESCRIPTION OF AN EXEMPLARY EMBODIMENT

The housing 1 of the fuel injection valve contains a valve closing member 2 with a conical sealing face 3, which comes into contact with a conical valve seat 4, from which injection bores 5 lead. The valve member is then acted upon by means of a compression spring 7 in the closing direction toward the valve seat 4. In the intermediary region of the valve closing member 2, a pressure chamber 9 is provided inside the housing with a pressure surface 10 that points in the opening direction of the valve closing member subjected to the pressure prevailing there. The pressure is supplied to the pressure chamber 9 via a high pressure supply line 11. The high pressure supply line communicates with a high pressure reservoir, not shown in detail, via a high pressure connection 12 that leads away perpendicular to the longitudinal axis of the injection valve. Coaxial to the compression spring 7, moreover, the valve closing member 2 is engaged by a tappet 14 which, with its end face 17, defines a control chamber 18 relative to an insert piece 15 in the housing 1 of the injection valve. From the high pressure connection 12, this control chamber has an inlet with a first throttle 19 and an outlet to a discharge line 21 with a second throttle 20, which is controlled by means of a valve member 22 of a solenoid valve 23. The solenoid valve 23 has a spring 24 that acts in the closing direction and an armature 25 on the valve member that is attracted by the electromagnet 26 of the solenoid valve when its coil 27 is excited and thus opens the second throttle 20. The housing 29 of the solenoid valve is attached by means of a union nut 30 to the housing 1 of the injection valve, coaxial to the position of the tappet 14 and the valve closing member 2.

Now a housing 31 of a circuit part is placed, according to the invention, on the end face of the housing 29 of the solenoid valve and as schematically depicted in the section, contains parts of the control circuit as a second switch part of the control circuit. The main part of the control circuit, in particular the signal processing, takes place in a first circuit part of the electrical control device, which circuit part is not shown in detail here, while in particular, the power components and energy stores are contained in the second circuit part inside the housing 32 as a second circuit part. The housing 32 also contains the electrical connection 33 with current supply and signal supply from the first circuit part. The housing 32 encloses an inner chamber 34, which contains the circuit parts mentioned, and which the fuel flows through, which is withdrawn in the direction of the discharge line 21 by means of the solenoid valve 23 in order to discharge the control chamber 18. The fuel circulates around the electromagnet and also the second circuit part downstream of it. To drain the incoming fuel, an outlet fitting 36 is disposed on the housing 32 and leads to a fuel reservoir via the discharge line 21. In this manner, the electromagnet and the second circuit part is intensively cooled.

The housing 32 is preferably comprised of plastic or insulation material with additional elastic properties in such a manner that the housing can also be sealingly clipped onto the housing 29 of the solenoid valve. Therefore an easy exchangeability is assured.

The foregoing relates to preferred exemplary embodiments of the invention, it being understood that other variants and embodiments thereof are possible within the spirit and scope of the invention, the latter being defined by the appended claims.

It is claimed:

1. A fuel injection valve for high pressure injection into combustion chambers of self-igniting internal combustion engines, comprising a solenoid valve (23) which indirectly controls a communication of the fuel injection valve with a high pressure fuel supply at least indirectly by means of an electrical control device, the electrical control device has a control circuit that is subdivided into a first, common circuit part that controls a number of fuel injection valves and second circuit parts (31) in which the second circuit parts are each respectively associated with a fuel injection valve to control a power supply to an electromagnet (26) of the solenoid valve (23) through which fuel flows to a discharge line (21), and said second circuit parts are disposed in a control housing (32) secured to said solenoid valve.

2. A fuel injection valve according to claim 1, in which the second circuit parts (31) essentially include power components and storage elements of the electrical control device and are disposed in said control housing (32) between the solenoid valve (23) and an electrical connection (33) of the injection valve.

3. A fuel injection valve according to claim 2, in which the control housing (32) also has a plug connection (33) for connecting to the first circuit part and is mounted onto a housing (29) of the solenoid valve.

4. A fuel injection valve according to claim 2, in which a discharge line (21) leading from the solenoid valve is routed through the control housing (32).

5. A fuel injection valve according to claim 4, in which the control housing (32) is constructed of plastic which is clipped onto the housing (29) of the solenoid valve in an elastically sealing manner.

6. A fuel injection valve according to claim 2, in which in an axial extension, the solenoid valve (23) is connected to a housing (1) of the fuel injection valve and the control housing (32) in turn is attached in an axial extension to the housing (29) of the solenoid valve.

* * * * *